US005081681A

United States Patent [19]

Hardwick et al.

[11] Patent Number: 5,081,681

[45] Date of Patent: Jan. 14, 1992

[54] METHOD AND APPARATUS FOR PHASE SYNTHESIS FOR SPEECH PROCESSING

[75] Inventors: John C. Hardwick, Cambridge; Jae S. Lim, Winchester, both of Mass.

[73] Assignee: Digital Voice Systems, Inc., Cambridge, Mass.

[21] Appl. No.: 444,042

[22] Filed: Nov. 30, 1989

[51] Int. Cl.[5] ..... G10L 5/00

[52] U.S. Cl. ..... 381/51; 381/37

[58] Field of Search ..... 381/41-43; 364/513.5

[56] References Cited

U.S. PATENT DOCUMENTS 3,982,070 9/1976 Flanagan ..... 381/51
3,995,116 11/1976 Flanagan ..... 381/51
4,856,068 8/1989 Quatieri et al. ..... 381/47

OTHER PUBLICATIONS

Griffin et al., "A New Pitch Detection Algorithm", Digital Signal Processing, No. 84, pp. 395-399.

Griffin et al., "A New Model-Based Speech Analysis/-Synthesis System", IEEE International Conference on Acoustics, Speech, and Signal Processing, ICASSP 1985, pp. 513-516.

McAulay et al., "Mid-Rate Coding Based on a Sinusoidal Representation of Speech", IEEE 1985, pp. 945-948.

McAulay et al., "Computationally Efficient Sine-Wave Synthesis and Its Application to Sinusoidal Transform Coding", IEEE 1988, pp. 370-373.

Hardwick, "A 4.8 Kbps Multi-Band Excitation Speech Coder", Thesis for Degree of Master of Science in Electrical Engineering and Computer Science, Massachusetts Institute of Technology, May 1988.

Griffin, "Multi-Band Excitation Vocoder", Thesis for Degree of Doctor of Philosophy, Massachusetts Institute of Technology, Feb. 1987.

Portnoff, "Short-Time Fourier Analysis of Sampled Speech", IEEE Transactions on Acoustics, Speech, and Signal Processing, vol. ASSP-29, No. 3, Jun. 1981, pp. 324-333.

Griffin et al., "Signal Estimation from Modified Short-Time Fourier Transform", IEEE Transactions on Acoustics, Speech, and Signal Processing, vol. ASSP-32, No. 2, Apr. 1984, pp. 236-243.

Almeida et al., "Harmonic Coding: A Low Bit-Rate, Good-Quality Speech Coding Technique", IEEE (1982) CH1746/7/82, pp. 1664-1667.

Quatieri et al., "Speech Transformations Based on a Sinusoidal Representation", IEEE Transactions on Acoustics, Speech, and Signal Processing, vol. ASSP-34, No. 6, Dec. 1986, pp. 1449-1464.

Griffin et al., "Multiband Excitation Vocoder", IEEE Transactions on Acoustics, Speech, and Signal Processing, vol. 36, No. 8, Aug., 1988, pp. 1223-1235.

Almeida et al., "Variable-Frequency Synthesis: An Improved Harmonic Coding Scheme", ICASSP 1984, pp. 27.5.1-27.5.4.

Flanagan, J. L., *Speech Analysis Synthesis and Perception*, Springer-Verlag, 1972, pp. 378-386.

*Primary Examiner*—Emanuel S. Kemeny
*Attorney, Agent, or Firm*—Fish & Richardson

[57] ABSTRACT

A class of methods and related technology for determining the phase of each harmonic from the fundamental frequency of voiced speech. Applications of this invention include, but are not limited to, speech coding, speech enhancement, and time scale modification of speech. Features of the invention include recreating phase signals from fundamental frequency and voiced-/unvoiced information, and adding a random component to the recreated phase signal to improve the quality of the synthesized speech.

22 Claims, 1 Drawing Sheet

METHOD AND APPARATUS FOR PHASE SYNTHESIS FOR SPEECH PROCESSING

The present invention relates to phase synthesis for speech processing applications.

There are many known systems for the synthesis of speech from digital data. In a conventional process, digital information representing speech is submitted to an analyzer. The analyzer extracts parameters which are used in a synthesizer to generate intelligible speech. See Portnoff, "Short-Time Fourier Analysis of Sampled Speech", IEEE TASSP, Vol. ASSP-29, No. 3, June 1981, pp. 364–373 (discusses representation of voiced speech as a sum of cosine functions); Griffin, et al., "Signal Estimation from Modified Short-Time Fourier Transform", IEEE, TASSP, Vol. ASSP-32, No. 2, April 1984, pp. 236–243 (discusses overlap-add method used for unvoiced speech synthesis); Almeida, et al., "Harmonic Coding: A Low Bit-Rate, Good-Quality Speech Coding Technique", IEEE, CH 1746, July 1982, pp. 1664–1667 (discusses representing voiced speech as a sum of harmonics); Almeida, et al., "Variable-Frequency Synthesis: An Improved Harmonic Coding Scheme", ICASSP 1984, pages 27.5.1–27.5.4 (discusses voiced speech synthesis with linear amplitude polynomial and cubic phase polynomial); Flanagan, J. L., *Speech Analysis, Synthesis and Perception,* Springer-Verlag, 1972, pp. 378–386 (discusses phase vocoder—frequency-based analysis/synthesis system); Quatieri, et al., "Speech Transformations Based on a Sinusoidal Representation", IEEE TAASP, Vol. ASSP34, No. 6, December 1986, pp. 1449–1986 (discusses analysis-synthesis technique based on sinusoidal representation); and Griffin, et al., "Multiband Excitation Vocoder", IEEE TASSP, Vol. 36, No. 8, August 1988, pp. 1223–1235 (discusses multiband excitation analysis-synthesis). The contents of these publications are incorporated herein by reference.

In a number of speech processing applications, it is desirable to estimate speech model parameters by analyzing the digitized speech data. The speech is then synthesized from the model parameters. As an example, in speech coding, the estimated model parameters are quantized for bit rate reduction and speech is synthesized from the quantized model parameters. Another example is speech enhancement. In this case, speech is degraded by background noise and it is desired to enhance the quality of speech by reducing background noise. One approach to solving this problem is to estimate the speech model parameters accounting for the presence of background noise and then to synthesize speech from the estimated model parameters. A third example is time-scale modification, i.e., slowing down or speeding up the apparent rate of speech. One approach to time-scale modification is to estimate speech model parameters, to modify them, and then to synthesize speech from the modified speech model parameters.

SUMMARY OF THE INVENTION

In the present invention, the phase $\Theta_k(t)$ of each harmonic k is determined from the fundamental frequency $\omega(t)$ according to voicing information $V_k(t)$. This method is simple computationally and has been demonstrated to be quite effective in use.

In one aspect of the invention an apparatus for synthesizing speech from digitized speech information includes an analyzer for generation of a sequence of voiced/unvoiced information, $V_k(t)$, fundamental angular frequency information, $\omega(t)$, and harmonic magnitude information signal $A_k(t)$, over a sequence of times $t_0 \ldots t_n$, a phase synthesizer for generating a sequence of harmonic phase signals $\Theta_k(t)$ over the time sequence $t_0 \ldots t_n$ based upon corresponding ones of voiced/unvoiced information $V_k(t)$ and fundamental angular frequency information $\omega(t)$, and a synthesizer for synthesizing speech based upon the generated parameters $V_k(t)$, $\omega(t)$, $A_k(t)$ and $\Theta_k(t)$ over the sequence $t_0 \ldots t_n$.

In another aspect of the invention a method for synthesizing speech from digitized speech information includes the steps of enabling analyzing digitized speech information and generating a sequence of voiced/unvoiced information signals $V_k(t)$, fundamental angular frequency information signals $\omega(t)$, and harmonic magnitude information signals $A_k(t)$, over a sequence of times $t_0 \ldots t_n$, enabling synthesizing a sequence of harmonic phase signals $\Theta_k(t)$ over the time sequence $t_0 \ldots t_n$ based upon corresponding ones of voiced/unvoiced information signals $V_k(t)$ and fundamental angular frequency information signals $\omega(t)$, and enabling synthesizing speech based upon the parameters $V_k(t)$, $\omega(t)$, $A_k(t)$ and $\Theta_k(t)$ over the sequence $t_0 \ldots t_n$.

In another aspect of the invention, an apparatus for synthesizing a harmonic phase signal $\Theta_k(t)$ includes means for receiving voiced/unvoiced information $V_k(t)$ and fundamental angular frequency information $\omega(t)$, means for processing $V_k(t)$ and $\omega(t)$ and generating intermediate phase information $\phi_k(t)$, means for obtaining a random phase component $r_k(t)$, and means for synthesizing $\Theta_k(t)$ by addition of $r_k(t)$ to $\phi_k(t)$.

In another aspect of the invention, a method for synthesizing a harmonic phase signal $\Theta_k(t)$ includes the steps of enabling receiving voiced/unvoiced information $V_k(t)$ and fundamental angular frequency information $\omega(t)$, enabling processing $V_k(t)$ and $\omega(t)$, generating intermediate phase information $\phi_k(t)$, and obtaining a random component $r_k(t)$, and enabling synthesizing $\Theta_k(t)$ by combining $\phi_k(t)$ and $r_k(t)$.

Preferably, $$\phi_k(t_1) = \phi_k(t_o) + \int_{\tau = t_o}^{t_1} k\omega(\tau)d\tau$$

wherein the initial $\phi_k(t)$ can be set to zero or some other initial value;

$$\omega(t) = \omega(t_o) + (\omega(t_1) - \omega(t_o))\frac{t - t_o}{t_1 - t_o}, \; t_o \leqq t \leqq t_1,$$

wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

Preferably, the random component $r_k(t)$ has a large magnitude on average when the percentage of unvoiced harmonics at time t is high.

Other advantages and features will become apparent from the following description of the preferred embodiment and from the claims.

DETAILED DESCRIPTION OF THE PREFERRED EMBODIMENT

Figure 1:
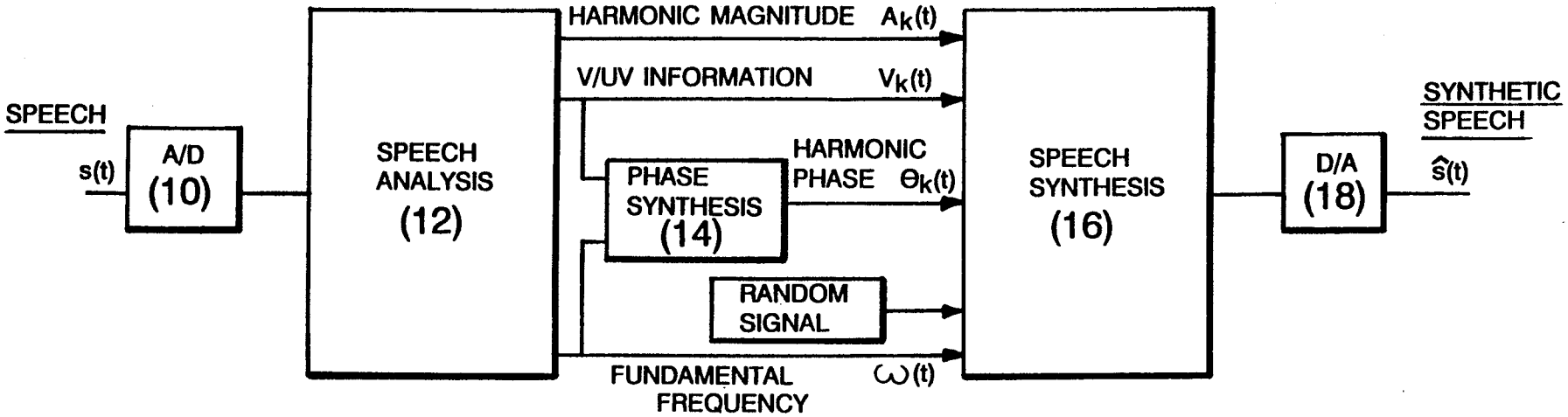

Various speech models have been considered for speech communication applications. In one class of speech models, voiced speech is considered to be periodic and is represented as a sum of harmonics whose frequencies are integer multiples of a fundamental frequency. To specify voiced speech in this model, the fundamental frequency and the magnitude and phase of each harmonic must be obtained. The phase of each harmonic can be determined from fundamental frequency, voiced/unvoiced information and/or harmonic magnitude, so that voiced speech can be specified by using only the fundamental frequency, the magnitude of each harmonic, and the voiced/unvoiced information. This simplification can be useful in such applications as speech coding, speech enhancement and time scale modification of speech.

We use the following notation in the discussion that follows:

$A_k(t)$: kth harmonic magnitude (a function of time t).

$V_k(t)$: voicing/unvoicing information for kth harmonic (as a function of time t).

$\omega(t)$: fundamental angular frequency in radians/sec (as a function of time t).

$\Theta_k(t)$: phase for kth harmonic in radians (as a function of time t).

$\phi_k(t)$: intermediate phase for kth harmonic (as a function of time t).

N(t): Total number of harmonics of interest (as a function of time t).

FIG. 1 is a block schematic of a speech analysis/synthesizing system incorporating the present invention, where speech s(t) is converted by A/D converter 10 to a digitized speech signal.

Analyzer 12 processes this speech signal and derives voiced/unvoiced information $V_k(t)$, fundamental angular frequency information $\omega(t)$, and harmonic magnitude information $A_k(t)$. Harmonic phase information $\Theta_k(t)$ is derived from fundamental angular frequency information $\omega(t)$ in view of voiced/unvoiced information $V_k(t)$. These four parameters, $A_k(t)$, $V_k(t)$, $\Theta_k(t)$, and $\omega(t)$, are applied to synthesizer 16 for generation of synthesized digital speech signal which is then converted by D/A converter 18 to analog speech signal $\hat{s}(t)$. Even though the output at the A/D converter 10 is digital speech, we have derived our results based on the analog speech signal s(t). These results can easily be converted into the digital domain. For example, the digital counterpart of an integral is a sum.

More particularly, phase synthesizer 14 receives the voiced/unvoiced information $V_k(t)$ and the fundamental angular frequency information $\omega(t)$ as inputs and provides as an output the desired harmonic phase information $\Theta_k(t)$. The harmonic phase information $\Theta_k(t)$ is obtained from an intermediate phase signal $\phi_k(t)$ for a given harmonic. The intermediate phase signal $\phi_k(t)$ is derived according to the following formula:

$$\phi_k(t_1) = \phi_k(t_o) + \int_{\tau = t_o}^{t_1} k\omega(\tau)d\tau \tag{1}$$

where $\phi_k(t_0)$ is obtained from a prior cycle. At the very beginning of processing, $\phi_k(t)$ can be set to zero or some other initial value.

As described in a later section, the analysis parameters $A_k(t)$, $\omega(t)$, and $V_k(t)$ are not estimated at all times t. Instead the analysis parameters are estimated at a set of discrete times $t_0$, $t_1$, $t_2$, etc . . . . The continuous fundamental angular frequency, $\omega(t)$, can be obtained from the estimated parameters in various manners. For example, $\omega(t)$ can be obtained by linearly interpolating the estimated parameters $\omega(t_0)$, $\omega(t_1)$, etc. In this case, $\omega(t)$ can be expressed as $$\omega(t) = \omega(t_o) + (\omega(t_1) - \omega(t_o))\frac{t - t_o}{t_1 - t_o}, \; t_o \leqq t \leqq t_1 \tag{2}$$

Equation 2 enables equation 1 as follows:

$$\phi_k(t_1) = \phi_k(t_o) + k\left(\frac{\omega(t_o) + \omega(t_1)}{2}\right)(t_1 - t_o) \tag{3}$$

Since speech deviates from a perfect voicing model, a random phase component is added to the intermediate phase component as a compensating factor. In particular, the phase $\Theta_k(t)$ for a given harmonic k as a function of time t is expressed as the sum of the intermediate phase $\phi_k(t)$ and an additional random phase component $r_k(t)$, as expressed in the following equation:

$$\Theta_k(t) + \phi_k(t) + r_k(t) \tag{4}$$

The random phase component typically increases in magnitude, on average, when the percentage of unvoiced harmonics increases, at time t. As an example, $r_k(t)$ can be expressed as follows:

$$r_k(t) = \alpha(t) \cdot u_k(t) \tag{5}$$

The computation of $r_k(t)$ in this example, relies upon the following equations:

$$P(t) = \sum_{k=1}^{N(t)} V_k(t) \tag{6}$$

$$\text{where } V_k(t) = \begin{cases} 1, \text{ if the } k\text{th harmonic is voiced} \\ 0, \text{ if the } k\text{th harmonic is unvoiced} \end{cases} \tag{7}$$

$$\text{and } \alpha(t) = \frac{N(t) - P(t)}{N(t)} \tag{8}$$

where P(t) is the number of voiced harmonics at time t and $\alpha(t)$ is a scaling factor which represents the approximate percentage of total harmonics represented by the unvoiced harmonics. It will be appreciated that where $\alpha(t)$ equals zero, all harmonics are fully voiced such that N(t) equals P(t). $\alpha(t)$ is at unity when all harmonics are unvoiced, in which case P(t) is zero. $\alpha(t)$ is obtained from equation 8.$u_k(t)$ is a white random signal with $u_k(t)$ being uniformly distributed between $[-\pi, \pi]$. It should be noted that N(t) depends on $\omega(t)$ and the bandwidth of interest of the speech signal s(t).

As a result of the foregoing it is now possible to compute $\phi_k(t)$, and from $\phi_k(t)$ to compute $\Theta_k(t)$. Hence, it is possible to determine $\phi_k(t)$ and thus $\Theta_k(t)$ for any given time based upon the time samples of the speech model parameters $\omega(t)$ and $V_k(t)$. Once $\Theta_k(t_1)$ and $\phi_k(t_1)$ are obtained, they are preferably converted to their principal values (between zero and $2\pi$). The principal value of $\phi_k(t_1)$ is then used to compute the intermediate phase of the kth harmonic at time $t_2$, via equation 1.

The present invention can be practiced in its best mode in conjunction with various known analyzer/synthesizer systems. We prefer to use the MBE analyzer/-synthesizer. The MBE analyzer does not compute the speech model parameters for all values of time t. Instead, $A_k(t)$, $V_k(t)$ and $\omega(t)$ are computed at time instants $t_0, t_1, t_2, \ldots t_n$. The present invention then may be used to synthesize the phase parameter $\Theta_k(t)$. In the MBE system, the synthesized phase parameter along with the sampled model parameters are used to synthesize a voiced speech component and an unvoiced speech component. The voiced speech component can be represented as $$\hat{s}_v(t) = \sum_{k=1}^{N(t)} \hat{A}_k(t) \cdot \cos\hat{\Theta}_k(t) \tag{9}$$

$$\text{where } \hat{\Theta}_k(t) = \int_{\tau = t_o}^{t} \omega_k(\tau)d\tau + \hat{\Theta}_k(t_o). \tag{10}$$

Typically $\hat{\Theta}_k(t)$ is chosen to be some smooth function (such as a low-order polynomial) that satisfies the following conditions for all sampled time instants $t_i$:

$$\hat{\Theta}_k(t_i) = \Theta_k(t_i), \tag{11}$$

$$\text{and } \frac{d\hat{\Theta}_k(t)}{dt}\bigg|_{t=t_i} = \omega_k(t_i) = k\omega(t_i). \tag{12}$$

Typically $\hat{A}_k(t)$ is chosen to be some smooth function (such as a low-order polynomial) that satisfies the following conditions for all sampled time instants $t_i$:

$$\hat{A}_k(t_i) = A_k(t_i) \tag{13}$$

Unvoiced speech synthesis is typically accomplished with the known weighted overlap-add algorithm. The sum of the voiced speech component and the unvoiced speech component is equal to the synthesized speech signal $\hat{s}(t)$. In the MBE synthesis of unvoiced speech, the phase $\Theta_k(t)$ is not used. Nevertheless, the intermediate phase $\phi_k(t)$ has to be computed for unvoiced harmonics as well as for voiced harmonics. The reason is that the kth harmonic may be unvoiced at time t' but can become voiced at a later time t''. To be able to compute the phase $\Theta_k(t)$ for all voiced harmonics at all times, we need to compute $\phi_k(t)$ for both voiced and unvoiced harmonics.

The present invention has been described in view of particular embodiments. However, the invention applies to many synthesis applications where synthesis of the harmonic phase signal $\Theta_k(t)$ is of interest.

What is claimed is:

1. A method for synthesizing speech, wherein the harmonic phase signal $\Theta_k(t)$ in voiced speech is synthesized by the method comprising the steps of enabling receiving voice/unvoiced information $V_k(t)$ and fundamental angular frequency information $\omega(t)$, enabling processing $V_k(t)$ and $\omega(t)$, generating intermediate phase information $\phi_k(t)$, and obtaining a random component $r_k(t)$, and enabling synthesizing $\Theta_k(t)$ of voiced speech by combining $\phi_k(t)$ and $r_k(t)$.

2. The method of claim 1 wherein $$\phi_k(t_1) = \phi_k(t_o) + \int_{\tau = t_o}^{t_1} k\omega(\tau)d\tau$$

and wherein the initial $\phi_k(t)$ can be set to zero or some other initial value.

3. The method of claim 1 wherein $$\omega(t) = \omega(t_o) + (\omega(t_1) - \omega(t_o))\frac{t - t_o}{t_1 - t_o}, \; t_o \leqq t \leqq t_1.$$

4. The method of claim 1 wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

5. The method of claim 1 wherein the random component $r_k(t)$ has a large magnitude on average when the percentage of unvoiced harmonics at time t is high.

6. An apparatus for synthesizing speech, wherein the harmonic phase signal $\Theta_k(t)$ in voiced speech is synthesized, said apparatus comprising means for receiving voiced/unvoiced information $V_k(t)$ and fundamental angular frequency information $\omega(t)$ means for processing $V_k(t)$ and $\omega(t)$ and generating intermediate phase information $\phi_k(t)$, means for obtaining a random phase component $r_k(t)$, and means for synthesizing $\Theta_k(t)$ of voiced speech by addition of $r_k(t)$ to $\phi_k(t)$.

7. The apparatus of claim 6 wherein $\phi_k(t)$ is derived according to the following:

$$\phi_k(t_1) = \phi_k(t_o) + \int_{\tau = t_o}^{t_1} k\omega(\tau)d\tau$$

and wherein the initial $\phi_k(t)$ can be set to zero or some other initial value.

8. The apparatus of claim 6 wherein $\omega(t)$ can be derived according to the following:

$$\omega(t) = \omega(t_o) + (\omega(t_1) - \omega(t_o))\frac{t - t_o}{t_1 - t_o}, \; t_o \leqq t \leqq t_1.$$

9. The apparatus of claim 6 wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

10. The apparatus of claim 6 wherein the random component $r_k(t)$ has a large magnitude on average when the percentage of unvoiced harmonics at time t is high.

11. An apparatus for synthesizing speech from digitized speech information, comprising an analyzer for generation of a sequence of voice/unvoiced information, $V_k(t)$, fundamental angular frequency information $\omega(t)$, and harmonic magnitude information signal $A_k(t)$, over a sequence of times $t_0 \ldots t_n$, a phase synthesizer for generating a sequence $t_0 \ldots t_n$ based upon corresponding ones of voiced/unvoiced information $V_k(t)$ and fundamental angular frequency information $\omega(t)$, and a synthesizer for synthesizing voiced speech based upon the generated parameters $V_k(t)$, $\omega(t)$, $A_k(t)$, and $\Theta_k(t)$ over the sequence $t_0 \ldots t_n$.

12. The apparatus of claim 11 wherein the phase synthesizer includes means for receiving voiced/unvoiced information $V_k(t)$ and fundamental angular frequency information $\omega(t)$, means for processing $V_k(t)$ and $\omega(t)$ and generating intermediate phase information $\phi_k(t)$, and means for obtaining a random phase component $r_k(t)$ and synthesizing $\theta_k(t)$ by addition of $r_k(t)$ to $\phi_k(t)$.

13. The apparatus of claim 11 wherein $\phi_k(t)$ is derived according to the following:

$$\phi_k(t_1) = \phi_k(t_o) + \int_{\tau = t_o}^{t_1} k\omega(\tau)d\tau$$

and wherein the initial $\phi_k(t)$ can be set to zero or some other initial value.

14. The apparatus of claim 11 wherein $\omega(t)$ can be derived according to the following:

$$\omega(t) = \omega(t_o) + (\omega(t_1) - \omega(t_o))\frac{t - t_o}{t_1 - t_o}, \; t_o \leqq t \leqq t_1.$$

15. The apparatus of claim 11 wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

16. The apparatus of claim 11 wherein the random component $r_k(t)$ has a large magnitude on average when the percentage of unvoiced harmonics at time t is high.

17. A method for synthesizing speech from digitized speech information, comprising the steps of enabling analyzing digitized speech information and generating a sequence of voiced/unvoiced information signals $V_k(t)$, fundamental angular frequency information signals $\omega(t)$, and harmonic magnitude information signals $A_k(t)$, over a sequence of times $t_0 \ldots t_n$, enabling synthesizing a sequence of harmonic phase signals $\Theta_k(t)$ over the time sequence $t_0 \ldots t_n$ based upon corresponding ones of voiced/unvoiced information signals $V_k(t)$ and fundamental angular frequency information signals $\omega(t)$, and enabling synthesizing voiced speech based upon the parameters $V_k(t)$, $\omega(t)$, $A_k(t)$, and $\Theta_k(t)$ over the sequence $t_0 \ldots t_n$.

18. The method of claim 17 wherein synthesizing a harmonic phase signal $\Theta_k(t)$ comprises the steps of enabling receiving voiced/unvoiced information $V_k(t)$ and fundamental angular frequency information $\omega(t)$, enabling processing $V_k(t)$ and $\omega(t)$ and generating intermediate phase information $\phi_k(t)$, obtaining a random component $r_k(t)$, and synthesizing $\Theta_k(t)$ by combining $\phi_k(t)$ and $r_k(t)$.

19. The method of claim 17 wherein $$\phi_k(t_1) = \phi_k(t_o) + \int_{\tau = t_o}^{t_1} k\omega(\tau)d\tau$$

and wherein the initial $\phi_k(t)$ can be set to zero or some other initial value.

20. The method of claim 17 wherein $$\omega(t) = \omega(t_o) + (\omega(t_1) - \omega(t_o))\frac{t - t_o}{t_1 - t_o}, \; t_o \leqq t \leqq t_1.$$

21. The method of claim 17 wherein the random component $r_k(t)$ has a large magnitude on average when the percentage of unvoiced harmonics at time t is high.

22. The method of claim 17 wherein $r_k(t)$ is expressed as follows:

$$r_k(t)=\alpha(t)\cdot u_k(t)$$

where $u_k(t)$ is a White random signal with $u_k(t)$ being uniformly distributed between $[-\pi, \pi]$, and where $\alpha(t)$ is obtained from the following:

$$\alpha(t) = \frac{N(t) - P(t)}{N(t)}$$

where N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

* * * * *

UNITED STATES PATENT AND TRADEMARK OFFICE

CERTIFICATE OF CORRECTION

PATENT NO. : 5,081,681

DATED : January 14, 1992

INVENTOR(S) : John C. Hardwick and Jae S. Lim

It is certified that error appears in the above-identified patent and that said Letters Patent is hereby corrected as shown below:

Column 3, line 48, "Analyzer" should not start a new paragraph.

Column 7, line 38, after "sequence", insert --of harmonic phase signals $\theta_k(t)$ over the time sequence--.

Column 9, line 1, "White" should be --white--.

Signed and Sealed this

Sixth Day of April, 1993

*Attest:*

STEPHEN G. KUNIN

*Attesting Officer*

*Acting Commissioner of Patents and Trademarks*

US005081681A

REEXAMINATION CERTIFICATE (2655th)

United States Patent [19]

[11] B1 5,081,681

Hardwick et al.

[45] Certificate Issued Aug. 15, 1995

[54] METHOD AND APPARATUS FOR PHASE SYNTHESIS FOR SPEECH PROCESSING

[75] Inventors: John C. Hardwick, Cambridge; Jae S. Lim, Winchester, both of Mass.

[73] Assignee: Digital Voice Systems, Inc., Cambridge, Mass.

Reexamination Requests:
No. 90/003,024, Apr. 12, 1993
No. 90/003,455, May 20, 1994

Reexamination Certificate for:

| | |
|---|---|
| Patent No.: | **5,081,681** |
| Issued: | **Jan. 14, 1992** |
| Appl. No.: | **444,042** |
| Filed: | **Nov. 30, 1989** |

Certificate of Correction issued Apr. 6, 1993.

[51] Int. Cl.[6] ..... G10L 5/00
[52] U.S. Cl. ..... 381/51; 381/37
[58] Field of Search ..... 381/29–40, 381/41–43, 51; 395/2, 2.14–2.29, 2.35, 2.37, 2.67, 2.73–2.77; 364/513.5

[56] References Cited

U.S. PATENT DOCUMENTS 5,054,072 10/1991 McAulay et al. ..... 381/38

OTHER PUBLICATIONS

"Multiband Excitation Vocoder", Daniel W. Griffin and Jae S. Lim, IEEE Transactions on Acoustics, Speech, and Signal Processing, vol. 36, No. 8, Aug., 1988.

"Multirate Sinusoidal Transform Coding at Rates From 2.4 kbps to 8 kbps", Robert J. McAuley and Thomas F. Quatieri, Proc. Int'l Conf. Acoustics, Speech and Signal Proc., ICASSP '87, Apr. 6–9, 1987, Dallas, Tex.

*Primary Examiner*—Allen R. MacDonald

[57] ABSTRACT

A class of methods and related technology for determining the phase of each harmonic from the fundamental frequency of voiced speech. Applications of this invention include, but are not limited to, speech coding, speech enhancement, and time scale modification of speech. Features of the invention include recreating phase signals from fundamental frequency and voiced-/unvoiced information, and adding a random component to the recreated phase signal to improve the quality of the synthesized speech.

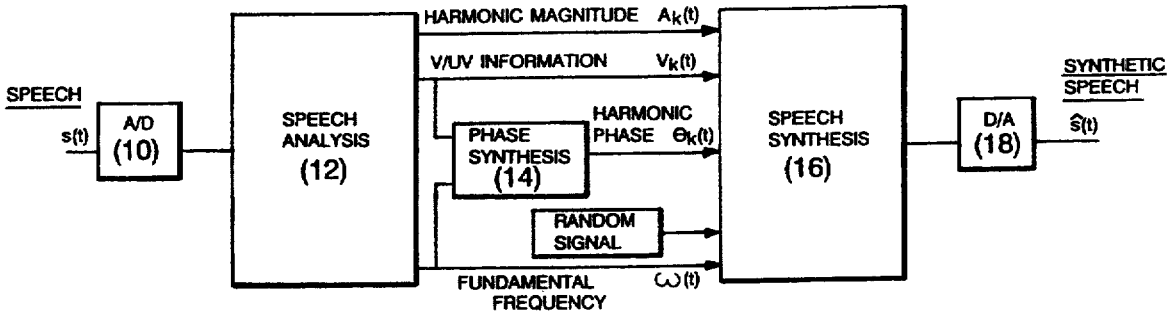

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no long a part of the patent; matter printed in italics indicates additions made to the patent.

AS A RESULT OF REEXAMINATION, IT HAS BEEN DETERMINED THAT:

Claims 11 and 17 are cancelled.

Claims 1, 6, 12–16 and 18–22 are determined to be patentable as amended.

Claims 2–5 and 7–10, dependent on an amended claim, are determined to be patentable.

1. A method for synthesizing speech, *by combining voiced and unvoiced frequency components coexisting at the same time instants,* wherein the *voiced frequency components are synthesized from a* harmonic phase signal $\theta_k(t)$ [in voiced speech is synthesized] by the method comprising the steps of

[enabling] receiving voiced/unvoiced information $V_k(t)$ and fundamental angular frequency information $\omega(t)$,

[enabling] processing $V_k(t)$ and $\omega(t)$, *using the voiced/unvoiced information to separate the voiced frequency components from the unvoiced frequency components,* generating intermediate phase information $\phi_k(t)$, and obtaining a random component $r_k(t)$, and

[enabling] synthesizing $\theta_k(t)$ of *the* voiced [speech] *frequency components* by combining $\phi_k(t)$ and $r_k(t)$, *and*

*wherein the unvoiced frequency components are synthesized by a method different from the method used for synthesizing the voiced frequency components.*

6. An apparatus for synthesizing speech *by combining voiced and unvoiced frequency components coexisting at the same time instants,* wherein the *voiced frequency components are synthesized from a* harmonic phase signal $\theta_k(t)$ [in voiced speech is synthesized, said apparatus] *using a first synthesizer* comprising means for receiving voiced/unvoiced information $V_k(t)$ and fundamental angular frequency information $\omega(t)$ means for processing $V_k(t)$ and $\omega(t)$, *using the voiced-/unvoiced information to separate the voiced frequency components from the unvoiced frequency components,* and generating intermediate phase information $\phi_k(t)$, means for obtaining a random phase component $r_k(t)$, and means for synthesizing $\theta_k(t)$ of *the* voiced [speech] *frequency components* by addition of $r_k(t)$ to $\phi_k(t)$; *and*

*wherein the apparatus comprises a second synthesizer for synthesizing the unvoiced frequency components using a technique different from the technique used for synthesizing the voiced frequency components.*

12. [The apparatus of claim 11] *An apparatus for synthesizing speech from digitized speech information by combining voiced and unvoiced frequency components coexisting at the same time instants, comprising*

*an analyzer for generation of a sequence of voiced/unvoiced information, $V_k(t)$, fundamental angular frequency information $\omega(t)$, and harmonic magnitude information signal $A_k(t)$, over a sequence of times $t_0 \ldots t_n$,*

*a phase synthesizer for generating a sequence of harmonic phase signals $\theta_k(t)$ over the time sequence $t_0 \ldots t_n$ based upon corresponding ones of voiced/unvoiced information $V_k(t)$ and fundamental angular frequency information $\omega(t)$, and*

*a first synthesizer for synthesizing the voiced frequency components based upon the generated parameters $V_k(t)$, $\omega(t)$, $A_k(t)$, and $\theta_k(t)$ over the sequence $t_0 \ldots t_n$,* wherein the [phase] *first* synthesizer includes means for receiving voiced/unvoiced information $V_k(t)$ and fundamental angular frequency information $\omega(t)$, means for processing $V_k(t)$ and $\omega(t)$, *using the voiced/unvoiced information to separate the voiced frequency components from the unvoiced frequency components,* and generating intermediate phase information $\phi_k(t)$, and means for obtaining a random phase component $r_k(t)$ and synthesizing $\theta_k(t)$ *of the voiced frequency components* by addition of $r_k(t)$ to $\phi_k(t)$; *and*

*wherein the apparatus comprises a second synthesizer for synthesizing the unvoiced frequency components using a technique different from the technique used for synthesizing the voiced frequency components.*

13. The apparatus of claim [11] *12* wherein $\phi_k(t)$ is derived according to the following:

$$\phi_k(t_1) = \phi_k(t_0) + \int_{\tau = t_0}^{t_1} k\omega(\tau)d\tau$$

and wherein the initial $\phi_k(t)$ can be set to zero or some other initial value.

14. The apparatus of claim [11] *12* wherein $\omega(t)$ can be derived according to the following:

$$\omega(t) = \omega(t_0) + (\omega(t_1) - \omega(t_0))\frac{t - t_0}{t_1 - t_0}, \; t_0 \leqq t \leqq t_1.$$

15. The apparatus of claim [11] *12* wherein $r_k(t)$ is exprressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

wherein $N(t)$ is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

16. The apparatus of claim [11] *12* wherein the random component $r_k(t)$ has a large magnitude on average when the percentage of unvoiced harmonics at time t is high.

18. [The method of claim 17] *A method for synthesizing speech from digitized speech information by combining voiced and unvoiced frequency components coexisting at the same time instants, comprising the steps of*

*analyzing digitized speech information and generating a sequence of voiced/unvoiced information signals $V_k(t)$, fundamental angular frequency information signals $\omega(t)$, and harmonic magnitude information signals $A_k(t)$, over a sequence of times $t_0 \ldots t_n$,*

*synthesizing a sequence of harmonic phase signals $\theta_k(t)$ over the time sequence $t_0 \ldots t_n$ based upon corresponding ones of voiced/unvoiced information signals $V_k(t)$ and fundamental angular frequency information signals $\omega(t)$, and*

*synthesizing the voiced frequency components based upon the parameters $V_k(t)$, $\omega(t)$, $A_k(t)$, and $\theta_k(t)$ over the sequence $t_0 \ldots t_n$,* wherein synthesizing a harmonic phase signal $\theta_k(t)$ comprises the steps of

[enabling] receiving voiced/unvoiced information $V_k(t)$ and fundamental angular frequency information $\omega(t)$,

[enabling] processing $V_k(t)$ and $\omega(t)$, *using the voiced/unvoiced information to separate the voiced frequency components from the unvoiced frequency components,* and generating intermediate phase information $\phi_k(t)$, obtaining a random component $r_k(t)$, and synthesizing $\theta_k(t)$ by combining $\phi_k(t)$ and $r_k(t)$; *and*

*synthesizing the unvoiced frequency components using a technique different from the technique used for synthesizing the voiced frequency components.*

19. The apparatus of claim [17] *18* wherein $$\phi_k(t_1) = \phi_k(t_0) + \int_{\tau = t_0}^{t_1} k\omega(\tau)d\tau$$

and wherein the initial $\phi_k(t)$ can be set to zero or some other initial value.

20. The apparatus of claim [17] *18* wherein $$\omega(t) = \omega(t_0) + (\omega(t_1) - \omega(t_0))\frac{t - t_0}{t_1 - t_0}, \; t_0 \leqq t \leqq t_1.$$

21. The apparatus of claim [17] *18* wherein the random component $r_k(t)$ has a large magnitude on average when the percentage of unvoiced harmonics at time t is high.

22. The apparatus of claim [17] *18* wherein $r_k(t)$ is expressed as follows:

$$r_k(t) = \alpha(t) \cdot u_k(t)$$

where $u_k(t)$ is a white random signal with $u_k(t)$ being uniformly distributed between $[-\pi, \pi]$, and where $\alpha(t)$ is obtained from the following:

$$\alpha(t) = \frac{N(t) - P(t)}{N(t)}$$

wherein N(t) is the total number of harmonics of interest as a function of time according to the relationship of $\omega(t)$ to the bandwidth of interest, and the number of voiced harmonics at time t is expressed as follows:

$$P(t) = \sum_{k=1}^{N(t)} V_k(t).$$

* * * * *